US005918477A

United States Patent [19]

Gall et al.

[11] Patent Number: 5,918,477

[45] Date of Patent: Jul. 6, 1999

[54] SURFACE TREATED COOLING DISK FOR FLAKE ICE MACHINE

[75] Inventors: Andrew T. Gall, Seattle; Don Bartholmey, Bellevue, both of Wash.

[73] Assignee: North Star Ice Equipment Corporation, Seattle, Wash.

[21] Appl. No.: 08/862,416

[22] Filed: May 23, 1997

Related U.S. Application Data

[63] Continuation-in-part of application No. 08/624,944, Mar. 29, 1996, Pat. No. 5,632,159.

[51] Int. Cl.[6] ..... F25C 1/14

[52] U.S. Cl. ..... 62/354

[58] Field of Search ..... 62/354; 165/133

[56] References Cited

U.S. PATENT DOCUMENTS

| | | | |
|---|---|---|---|
| 171,267 | 12/1875 | Cook . | |
| 202,886 | 4/1878 | Strunz . | |
| 2,054,841 | 9/1936 | Taylor . | |
| 2,641,064 | 6/1953 | Foner . | |
| 3,159,986 | 12/1964 | King . | |
| 3,191,398 | 6/1965 | Rader . | |
| 3,863,462 | 2/1975 | Treuer . | |
| 4,292,816 | 10/1981 | Gartzke . | |
| 4,527,401 | 7/1985 | Nelson . | |
| 4,799,543 | 1/1989 | Iversen et al. | 165/133 |
| 4,907,415 | 3/1990 | Stewart, Jr. et al. | 62/347 |
| 5,157,939 | 10/1992 | Lyon et al. . | |
| 5,307,646 | 5/1994 | Niblock . | |
| 5,448,894 | 9/1995 | Niblock . | |

FOREIGN PATENT DOCUMENTS

| | | |
|---|---|---|
| 53-80162 | 11/1977 | Japan . |
| 63-108177 | 5/1988 | Japan . |
| 1460095 | 12/1974 | United Kingdom . |
| WO85/03996 | 9/1985 | WIPO . |
| WO89/01120 | 2/1989 | WIPO . |

OTHER PUBLICATIONS

North Star® Ice Equipment Corporation, "Coldisc® D–12 Flake Ice Maker", *Flake Ice Technology*, 1994.

*Primary Examiner*—William E. Tapolcai
*Attorney, Agent, or Firm*—Christensen O'Connor Johnson & Kindness PLLC

[57] ABSTRACT

A flake ice machine (10) for producing flakes of frozen material. The machine includes a rotatable cooling disk (12) defining an external cooling surface (24) and an internal refrigerant flow passage (20). Refrigerant is supplied to the internal refrigerant flow passage to cool the disk. A motor drives rotation of the cooling disk, while a liquid material, such as fresh water, is supplied to the external cooling surface of the disk. An ice removal blade (30) is positioned adjacent the external cooling surface of the disk to remove flakes of frozen material. A low-wetting coating (90) is applied to the external cooling surface of the disk to enhance removal of large flakes of frozen material. In the preferred embodiment of the invention, the low-wetting coating comprises a fluoropolymer.

12 Claims, 3 Drawing Sheets

SURFACE TREATED COOLING DISK FOR FLAKE ICE MACHINE

CROSS REFERENCE TO RELATED APPLICATION

The present application is a continuation-in-part of prior copending application Ser. No. 08/624,944, filed Mar. 29, 1996, which will issue as U.S. Pat. No. 5,632,159.

FIELD OF THE INVENTION

The present invention relates to machines for freezing liquid material into solid form, and particularly, to machines for producing flake ice.

BACKGROUND OF THE INVENTION

Machines that continuously and automatically produce large quantities of flake ice are well known for use by the food processing industry, fishing industry, within grocery food stores, and for cooling concrete in construction to name a few. Flake ice machines have been developed that utilize a rotating cooling disk that is cooled by flow of a refrigerant through internal passages formed in the disk. Water or other liquid to be frozen is introduced to a portion of the side surfaces of the rotating disk, is sub-cooled, and is then removed as the disk rotates between a pair of ice removal blades positioned adjacent the side surfaces of the disk. An example of such a conventional flake ice machine is disclosed in U.S. Pat. Nos. 5,307,646 and 5,448,894 to Niblock, the disclosures of which are hereby expressly incorporated by reference.

In such conventional flake ice machines, the ice removal blades must not contact the side surfaces of the disk. Such contact results in rapid wear of the removal blades and/or disk which is unacceptable from both a maintenance and sanitary point of view. Simultaneously, the ice removal blades should be positioned as close to the disk side surfaces as possible to facilitate complete removal of ice from the disk surface each revolution. Any increase in blade spacing from the disk increases the likelihood of incomplete ice removal. If the blade/disk spacing is too great the blades will shear through the ice leaving a hardened layer or bumps of ice on the disk. The buildup of ice under the ice removal blades causes extra pressure, pushing the disk against the blades. Thereafter, the blades tend to push against this strongly adhered ice and cause deflections in the disk and resultant tool wear which compounds the problem. These type of stresses, as well as repeated thermal expansion and contraction stresses, can lead to permanent warpage of a disk, in the radial direction, out of the nominal plane of either disk cooling surface and render the machine nonfunctional.

Many conventional flake ice machines can only feasibly produce ice from soft water when a small quantity of salt has been added. The salt facilitates complete removal of ice from the disk side surfaces in large flakes. A salinity of 150–1,000 ppms, and most typically 250–500 ppms, is conventionally utilized to facilitate ice removal. Conventional flake ice machine may be outfitted with resiliently mounted blades or flexible blades for use in making salt-containing ice. The use of flexible or resiliently mounted blades is intended to eliminate or to permit reduction in the clearance between the blades and the disk. However, the use of salt is often undesirable for ice used for some purposes. Because fresh water ice is more difficult to remove, and particularly to remove in desirably large flakes rather than smaller pieces and fines, a rigidly mounted blade must be utilized to withstand the required shear force without yielding. Consequently, many conventional flake ice machines are not suitable for producing pure fresh water ice.

Previous flake ice machines that are suitable for producing fresh water ice maintain a clearance of approximately 0.010 to 0.012 inches between each rigidly mounted blade and the corresponding disk surface. Two factors have prevented smaller clearances. First, the disk is welded to the hub of a shaft for rotation about the central axis of the disk. As with all manufactured parts, disks tend to exhibit some axial runout, which causes the circumferential edge of the disk to wobble during rotation. Second, as noted above, the disks often flex during ice removal. The blade removal clearance must account for both of these factors to prevent blade/disk contact.

The refrigerant passages in conventional disk designs and manufacture used for both fresh and salt water ice manufacture exacerbate the problem of disk warpage. These disks include internal cooling passages that result in a relatively thin disk having low strength, particularly in the radial direction. Such conventional disks are manufactured using a chemical etching process to form the flow passages in the disk. The manufacture of conventional disks using a chemical etching process contributes to the disk's overall weakness by limiting its thickness. The chemical etching process removes material equally from both sides and the bottom of the passages. Therefore, the passage depth is limited to the design width. Otherwise, all the passages would run together. This fact limits the thickness of each disk half to the passage depth plus the thickness of the freezing surface after machining. For conventional disks, the total thickness of the assembly is typically less than ¼".

Regarding radial weakness of the conventional disk designs, U.S. Pat. No. 5,157,939 to Lyon et al. discloses a flake ice machine having numerous internal refrigerant passages. The disk is formed from two mating disk halves, each of which includes a plurality of chemically etched grooves on its internal surface. The pattern of the grooves in the two halves are mirror images, so that when the halves are mated and brazed together, corresponding grooves mate to form passages. The individual grooves are separated by narrow walls. The grooves are of a depth such that only a thin layer of disk material remains between the bottom of the groove and the outer cooling surface of the disk, for efficient heat transfer from the coolant. The primary structural strength of the disk is thus provided by the walls between the grooves.

The passages of the Lyon disk are arranged so that all of the passages have substantially the same length for achieving a uniform pressure drop in each passage, and so that all points on the disk side surfaces are close to the refrigerant. This attempts to ensure uniform cooling along the disk side surfaces and to prevent "hot" spots. To achieve this result, all of the initial portion of the passages extend radially outward a predetermined distance and then turn to run circumferentially for a substantial portion of their length before turning back in towards the disk hub.

The net result is that there are large portions of the radial segments of the disk, particularly at 90° to the inlet and outlet passages and extending towards the disks outer circumference, that include only circumferentially oriented passages, and not radially oriented passages. This arrangement results in the disk being significantly weakened in the radial direction, because the walls between the disks lend their rigidity and strength only in the circumferential direction in these disk segments. The ability of the disk to withstand temporary bending and permanent warpage, especially at the periphery of the disk, is substantially lessened by this passage arrangement. Moreover, dynamic forces that tend to cause warpage and bending, such as ice removal blade stresses due to disk wobble or incomplete ice removal, are greatest at the disk periphery.

Another drawback of conventional disk design is the possibility that one or more of the passages will become blocked with evaporated refrigerant, essentially becoming short circuited. Any blocked passages are thereafter not useful in disk cooling. Additionally, during manufacture of the disk, if the disk halves are not accurately matched during mating, cooling groove misalignment results and the disk is unusable.

SUMMARY OF THE INVENTION

The present invention provides an improved flake ice machine for producing flakes of a frozen material. A cooling disk for an evaporative refrigerant cooled flake ice machine includes a hollow disk member having: first and second circular side cooling surfaces; an axial aperture bounded by a circumferential hub wall spanning from the first to the second side cooling surface; a circumferential outer perimeter wall spanning from the first to the second side cooling surface; and an interior. The interior of the disk is partitioned by an internal wall pattern spanning from the first side cooling surface to the second side cooling surface. The wall pattern defines at least a first internal refrigerant flow passage extending from an inlet port into the interior of the disk member and returning to terminate at an outlet port. Each of the inlet and outlet ports open through the hub wall into the axial aperture. The internal wall pattern includes: an array of radial inner wall spokes extending radially from the hub wall to approach the perimeter wall; and an array of radial outer wall spokes extending radially from the perimeter wall to approach the hub wall. The inner wall spokes are interleaved with the outer wall spokes, so that the first passage winds radially back and forth from the hub wall to the perimeter wall between the interleaved inner and outer wall spokes to define a plurality of contiguous radial passage segments. In another aspect of the invention, a flake ice machine includes a cooling disk formed from a disk member having an axial aperture, a circumferential outer perimeter, and first and second side cooling surfaces. The disk member includes at least a first internal refrigerant flow passage extending from an inlet port into the interior of the disk member and returning to terminate at an outlet port. Each port opens onto the axial aperture. The first passage defines a first radial outflow segment extending radially from the inlet port to a point adjacent the perimeter. The first passage then passes through a turn at the point adjacent the perimeter to define a first radial return segment extending radially back to approach the axial aperture. The first radial outflow and return segments are separated by a first internal wall spoke. The first wall spoke spans from the first side cooling surface to the second side cooling surface, and extends radially from the axial aperture to the point adjacent to the perimeter.

The result of this construction is a disk which includes a plurality of radially oriented internal reinforcement ribs or spokes which strengthen the disk in the radial direction. This construction acts to significantly reduce bending or flexing of the disk during use, thus providing for a closer approach of the ice removal blades and more thorough removal of ice from the disk cooling surfaces. The strengthening also prevents warpage of the disk over time.

The design and method of manufacturing the disk to increase its thickness, and therefore, rigidity, is another aspect of the invention. The passages described above are suitably cut from a thick metal plate using a milling machine. The depth of the passages are determined by the initial thickness of the plate less the design thickness of the freezing surface before machining. This manufacturing method eliminates, within practical limits, prior limitations on the thickness of cooling plates associated with conventional chemical etching manufacturing processes. The cooling disk is completed by joining, such as by brazing, the milled plates to a flat plate matching the perimeter of the milled plate and having the same thickness as that of the freezing surface (wall thickness) of the milled plate, as measured between the bottom wall of the milled passages and the outer cooling surface of the milled plate. The radial orientation of the two disk components is not restricted by a need to match passages as is the case with conventional disks assembled from two halves, each chemically etched in mirror image fashion. This design allows the disk of the present invention to be manufactured to a predetermined thickness and degree of radial support to prevent the disk from flexing or warping under any load condition.

In a further aspect of the invention, the wall pattern includes short "island" walls positioned in the coolant passage which serve to intermittently break the refrigerant stream flowing through the passage into separate channels which then rejoin after passing the island. The result of this construction is to increase turbulence (due to change in velocity) of the fluid, thereby promoting mixing and more efficient heat transfer from the fluid to the disk exterior. The island walls also serve to strengthen the disk member along the passages to prevent rupture or loss of disk integrity.

In a still further aspect of the invention, the cooling surfaces of the disk are treated to enhance release of flakes of ice from the surfaces. Surface treatment may take the form of texturing or the application of a low-wetting coating. This facilitates removal of even fresh water ice in desirable large flakes.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
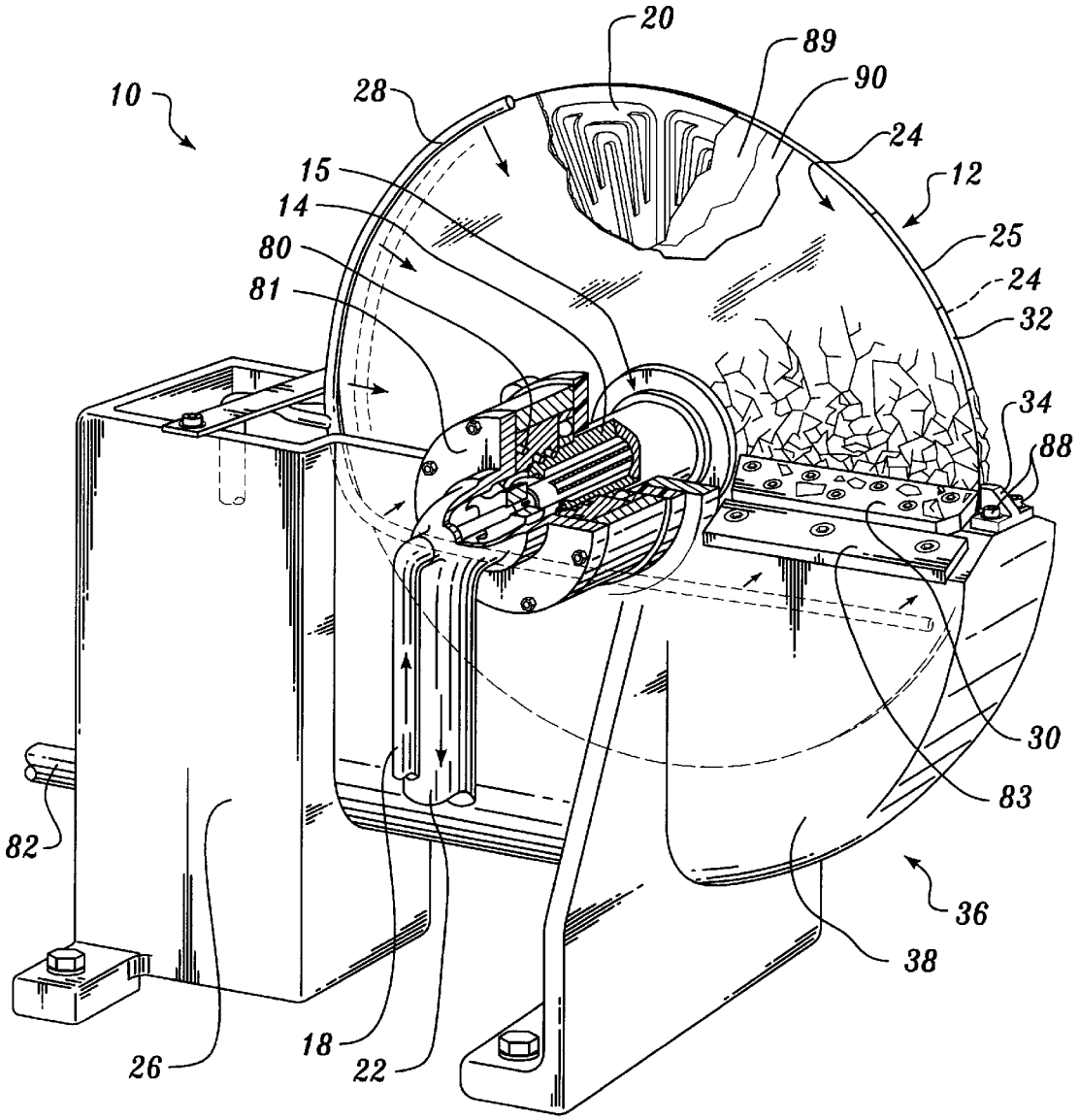
FIG. 1 provides a pictorial view of a flake ice machine constructed in accordance with the present invention, with the hub on which the disk cooling member is mounted being shown in partial section to illustrate the flow of refrigerant to and from the cooling member, and with a portion of the outer surface of one side of the cooling member being shown broken away to illustrate the internal refrigerant flow paths.

A flake ice machine 10 constructed in accordance with the present invention is shown in FIG. 1. The flake ice machine 10 includes a disk cooling member 12 mounted on a shaft 14 of a hub assembly 15 for rotation about the central axis of the cooling member 12. Rotation of the cooling member 12 is driven by a hollow shaft gear reducer with close coupled motor (not shown) engaged with the shaft 14. The cooling member 12 is cooled by flowing a refrigerant supplied from an inlet line 18 that flows through flow passages 20 formed within the interior of the cooling member 12. The refrigerant then exits the cooling member 12 through an outlet line 22.

The cooling member 12 has first and second circular sides, each of which defines a flat annular cooling surface 24, and a circumferential outer perimeter edge 25. Liquid material to be frozen, such as water, is introduced to the cooling surfaces 24. Water from a reservoir 26 is sprayed onto each cooling surface 24 through spray tubes 28. As the water flows over the cooling surfaces 24, it is frozen and then subcooled to form a layer of ice. A pair of ice removal blades 30 are disposed radially on opposite sides of the cooling member 12 and cause flakes of ice to be sheared from the disk surface. The blades 30 may be configured to have a scraper edge, as illustrated, or may have other configurations, such as a scalloped or toothed edge. Other ice removal tools could alternately be employed. A groove 32 is formed in the outer perimeter edge 25 of the cooling member 12, and is engaged by a guide member 34 that maintains the cooling member 12 centered between the ice removal blades 30, to limit wobble of the cooling member 12.

Construction of the flake ice machine 10 will now be described in greater detail. The flake ice machine 10 includes a housing 36 that forms the liquid reservoir 26 and a trough 38 that receives the lower half of the cooling member 12. The hub assembly 15 including the shaft 14 is mounted across the trough 38. The housing 36 is preferably constructed from a one-piece metal casting.

Figure 2:
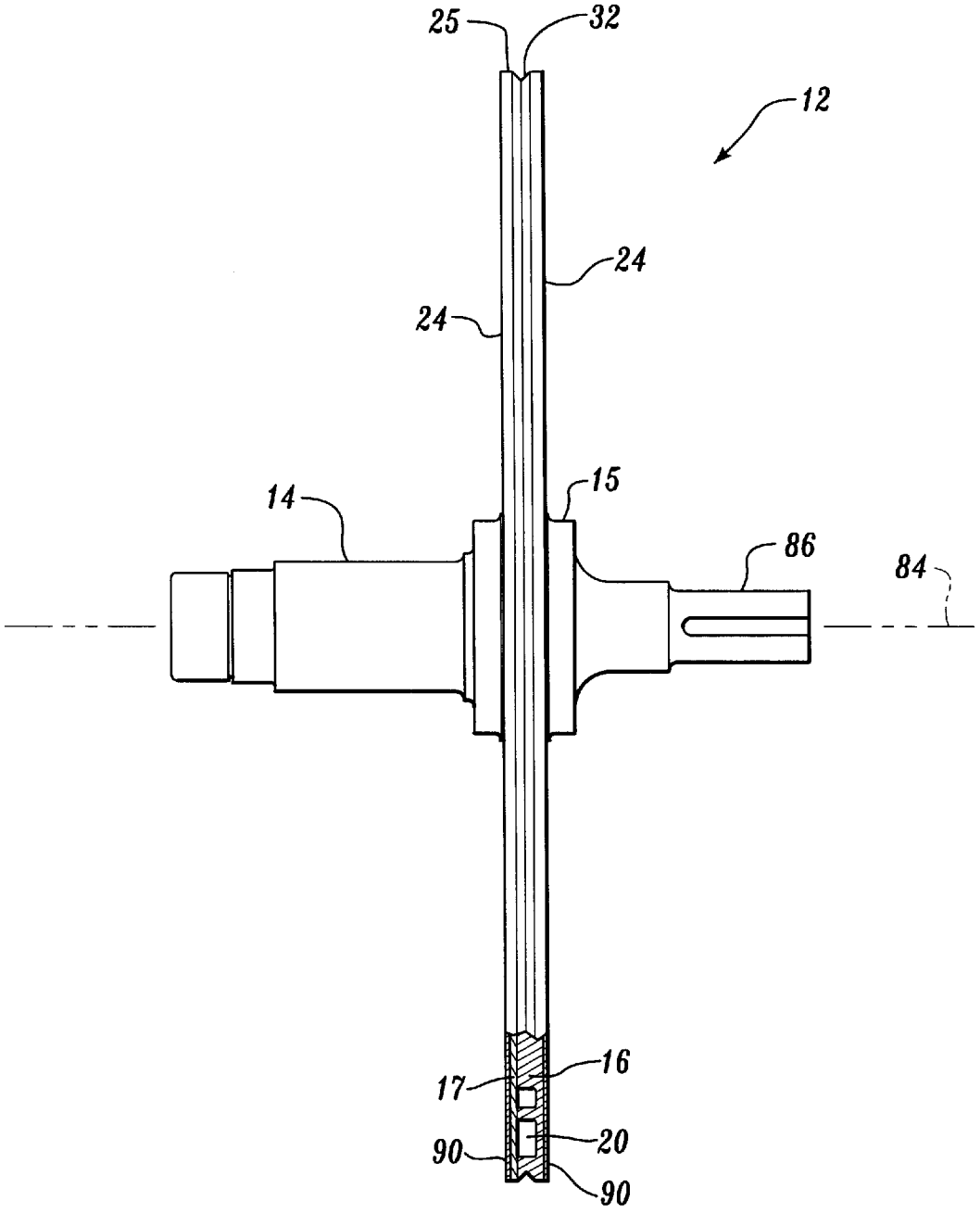
FIG. 2 provides a plan view of the cooling disk from FIG. 1, looking towards the circumferential edge of the disk cooling member, with a partial cross-section of the peripheral portion of the cooling member illustrating the internal refrigerant flow paths.

Referring to FIG. 2, the cooling member 12 is preferably formed from a disk-shaped base plate 16 into one side of which are milled the flow passages 20 as channels or grooves. The cooling member 12 is completed by a flat, disk-shaped cover plate 17 that mates with the machined side of the disk member 16 and is brazed thereto. The cover plate 17 completes the flow passages 20 by closing off the milled channels. Because the channels are preferably milled, rather than chemically etched as in prior disks, the disk 12 can be made thicker for greater strength. At the same time, the arrangement and depth of the passages 20 and the thickness of the cover plate 12 are predetermined so that all points on the cooling surfaces 24 are no more than a predetermined distance from the exterior walls of the flow passages 20, such as no more than approximately 0.1 inch. This insures uniform cooling of all disk surfaces. Preferably, the base plate 16 and cover plate 17 are formed from a type 405 stainless steel that has good thermal conductivity and machinability. The exterior cooling surfaces 24 are preferably textured by shot peening, such as with steel shot, followed by passivation (type I) to prevent corrosion. This texture enhances ice formation and removal. Other textures that enhance ice removal may also be utilized.

Figure 3:
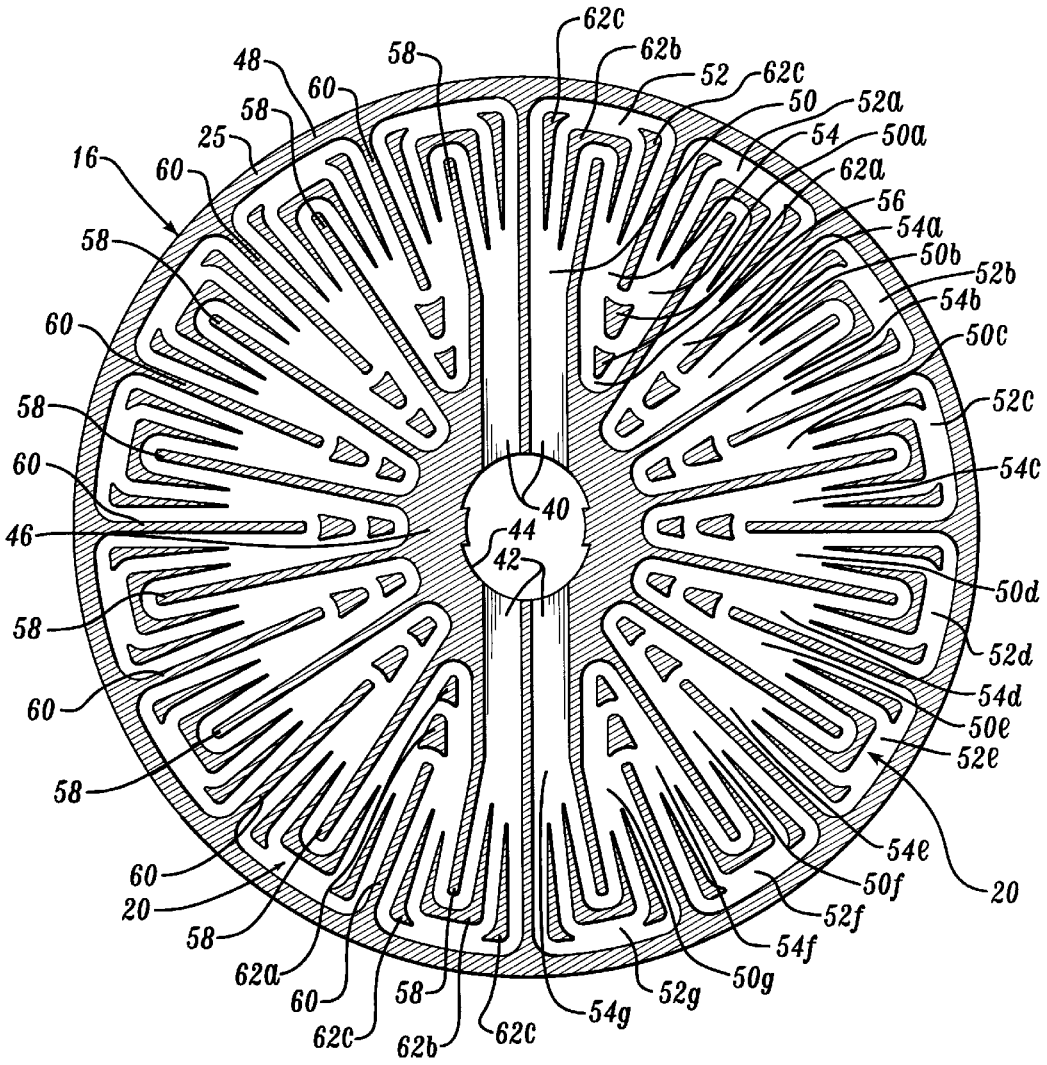
FIG. 3 provides a plan view of the milled side of the disk cooling member shown in FIGS. 1 and 2 with the cover plate removed to illustrate the internal refrigerant flow paths.

Referring to FIG. 3, the disk base plate 16 includes two flow passages 20 that each extend through a 180 degree sector of the disk-shape. Each flow passage 20 includes an inlet port 40 and an outlet port 42 which each open into an axial aperture 44 into which the hub assembly of the shaft 14 is mounted.

The two flow passages 20 are symmetrical, each being the mirror image of the other. The contour of the milled flow passages 20 leaves a non-milled pattern of internal walls that bound the passages 20. Thus there is an annular hub wall 46 that surrounds the axial aperture 44 and through which the inlet ports 40 and outlet ports 42 open. An annular perimeter wall 48 is defined within the outer perimeter edge 25 of the disk base plate 16.

From the inlet port 40 of each flow passage 20, a radial outflow segment 50 of the flow passage 20 extends radially outward until it reaches the non-milled perimeter wall 48 of the disk base plate 16. The flow passage 20 then turns to form a short tangentially oriented transition segment 52, and then extends back radially inward towards the hub wall 46 to define a radial return segment 54. After approaching the center of the disk member 12 at the hub wall 46, the passage 20 forms a bend 56 and then extends back radially outward towards the perimeter wall 50, forming another radial outflow segment 50*a*, then another tangential transition segment 52*a*, and then another radial inward return segment 54*a*. The flow passage 20 continues in this back and forth radial fashion through the entire 180 degree sector, through additional outflow segments 50*b*–50*g*, transition segments 52*b*–52*g*, and return segments 54*b*–54*g*. The last radial outflow segment 54*g* extends to the outlet port 42.

The radial outflow segments 50 and return segments 54 are bounded by non-milled radial inner spoke walls 58 that project substantially radially outward from the hub wall 46 of the disk member 16 to approach the perimeter wall 48, and interspersed radial outer spoke walls 60 that project substantially radially inward from the perimeter wall 48 to approach the hub wall 46. As can be seen from FIG. 3, the radial spoke walls 58 and 60 are formed at a generally uniform axial spacing around the central axis of the disk member 16, with outward and inward projecting spoke walls 58 and 60 alternating with one another. The radial walls 58 and 60 act as circuit spokes that provide radial rigidity for the outer portions of the cooling member 12 to prevent undesirable bending, flexing and/or warping. This arrangement simultaneously maintains a predetermined minimum distance (preferably 0.1 inch) from the flow passage 20 to the outer freezing surfaces 24 of the cooling member 12.

The two passages 20 including the outflow segments 50 and return segments 54 span and thus cool the entire 360° of the cooling member 12. All segments of the flow passages 20 are radially oriented except for the transition segments 52, which are only as long as necessary to permit the passage to make the turn necessary to begin the next radial segment. There thus is no segment of the disk which is not supported radially by the interspersed spoke walls 58 and 60.

Within the flow passages 20 at each of the inner bends 56 and the outer tangential transition segments 52 are non-milled island walls 62. The island walls 62 cause refrigerant flowing through the passage 20 at these locations to branch or split for short flow lengths into two or three branches, followed by rejoining after passing the island walls 62. The island walls 62 serve to reduce the span of the thin outer walls of the passage 20, preventing rupturing of the disk plate 16 outer wall and cover plate 17 under pressure. The island walls 62 also induce turbulent flow in the refrigerant, resulting in mixing of refrigerant in contact with the walls with refrigerant in the center of the passages. This mixture is believed to improve heat exchange from the refrigerant to the cooling surfaces 24.

There are two islands walls 62*a* disposed radially in line with each outer spoke wall 60, spaced between the innermost end of the outer spoke wall 60 and the hub wall 46. Each of these island walls 62*a* has a generally triangular cross-sectional shape pointing toward the center of the axial aperture 44. Thus refrigerant flowing through a turn 56 is momentarily split into three branches as it flows past the innermost end of each outer spoke wall 60.

Three additional island walls 62 are positioned adjacent to the radial outermost end of each inner spoke wall 58. One of these island walls 62*b* has a generally U-shaped cross-sectional configuration, and extends around the tip and either side of the end of the inner spoke wall 58. The other two island walls 62*c* are radially oriented on either side of the U-shaped island wall 62. Thus as the refrigerant approaches a transition segment 52, it momentarily branches into three branches, then into just two branches as it travels through the transition segment and then again momentarily into three branches as it enters the return segment 54. The leading and trailing edges of each of these divider island walls 62*b* and 62*c* opposite he ends of the inner spoke walls 58 are tapered.

Because the island walls 62 are relatively short compared with the length of the passage segments 50 and 54, they cause periodic mixing of the refrigerant within each fluid passage 20. In addition to enhancing cooling efficiency and heat transfer, this periodic mixing within each flow passage 20 also prevents the blockage of the passage by bubbles of evaporated refrigerant, which could effectively "short circuit" the flow passage as may occur in some conventional disk designs. The radially oriented islands walls 62 also serve to further increase the strength of the disk cooling member 12 in the radial direction.

The flake ice machine 10 is preferably operated with an evaporative refrigerant. Cold liquid refrigerant is supplied from the inlet line 18 to the inlet ports 40 of the internal flow passages 20, and flows through the disk to cool the surfaces 24 thereof. As the disk cooling surfaces 24 are cooled, the refrigerant evaporates, and then exits from the outlet ports 42 of the flow passages 20 to the outlet line 22. Refrigerant exiting the outlet line 22 is then condensed and cooled using a standard refrigeration circuit (not shown).

Referring to FIG. 1, the hub assembly 15 is sealed by a plurality of O-ring seals 80, which prevent leakage of refrigerant from the rotating shaft 14 and a non-rotating hub housing 81. The O-ring seals 80 are located in fluid flow communication with the low-pressure outlet line 22.

As mentioned previously, water or other material to be frozen is applied to each cooling surface 24 of the cooling member 12 by spray tubes 28. Each spray tube 28 includes a spaced series of perforations to dispense the water. The spray tubes 28 are formed and positioned such that water flows down one radial side portion and a bottom portion of each cooling surface 24 of the cooling member 12. Excess water then returns to the reservoir 26, which is additionally supplied by an inlet water line 82.

As the cooling surfaces 24 rotate past the spray tubes 28, a layer of frozen ice forms on each cooling surface 24. As the disk rotates further past the spray tubes 28, this material is supercooled so that it is very hard and dry. The ice layer then impacts the ice removal blades 30, where it is broken off in large flakes that slide off over the tops of the removal blades 30, which are set at an upward angle relative to the cooling surfaces 24. The flakes of ice then pass over low friction thermoplastic guide plates 83 secured to the housing 36. The flakes fall free of the housing 36, to be collected in a hopper (not shown) located below the housing 36.

Referring collectively to FIGS. 1 and 2, the cooling member 12 and shaft 14 are mounted to rotate on the central axis 84 of the cooling member 12. Rotation is driven by a novel hollow shaft gear reducer with close coupled motor (not shown), which is engaged with a drive end 86 of the shaft 14 on the opposite side of the cooling member 12 from the refrigerant supply. The drive end of the shaft extends completely through the hollow shaft of the gearbox. The end of the shaft is reduced in diameter and partially threaded to accept a thrust washer and locking nut. The thrust washer fits against the outer collar of the gearbox. The thrust washer is machined to accept on O-ring. This O-ring seals between the thrust washer and the gearbox and prevents outside moisture from entering into the shaft/gear reducer connection. A shoulder on the inner portion of the shaft provides an additional seat for an O-ring that fits between the inner collar of the gearbox and the shaft. By tightening the locking nut, the shaft shoulder on the inside and the thrust washer on the outside are pressed tightly against the respective collars of the gearbox. Thus, the drive shaft disk assembly can not move relative to the gearbox. The gearbox being tightly bolted to the frame, as are the ice removal blades, essentially eliminates all relative movement between the disk and the ice removal blades. The O-ring mounted in the face of the shaft shoulder presses up against an inner collar of the gearbox and prevents moisture from causing corrosion and seizing of the drive shaft onto the hollow shaft of the gear reducer. This preferred arrangement of the shaft and gear reducer provides for improved disassembly in the field. In a preferred embodiment, the motor is an electric motor that directly drives rotation through a worm gear linkage.

The V-shaped annular groove 32 is formed in the outer perimeter edge 25 of the cooling member 12. In the preferred embodiment, the width of the groove 32 extends approximately ¼" across the center of the outer perimeter edge 25. While the groove 32 may be either obtusely or acutely angled, in the preferred embodiment it is angled at approximately 90 degrees.

The guide member 34 is secured by bolts 88 to the top of the trough 38 of the housing 36, adjacent to and facing the outer perimeter edge 25 of the cooling member 12. As the cooling member 12 covered with frozen ice rotates toward the ice removal blades 30, the guide member 34 fractures and removes ice from the outer perimeter edge 25 of the cooling member 12 just before ice impacts the removal blades 30. The forward projection of the guide member 34 acts as a "plow" that initiates ice removal radially upstream of the ice removal blades 30. Thus, the strong ice that is formed on the annular comers defined by the junction of the cooling surfaces 24 and the peripheral edge 25 is first broken by the guide member 34 so that the ice removal blades 30 may more readily remove ice on the radially outermost portions of the cooling surfaces 24. Because ice is also harvested from the circumferential outer perimeter edge 25, i.e. from the groove 32, the overall efficiency of the cooling member 12 is increased proportional to the increase in total surface area from which ice is harvested.

The guide member 34 also constrains and centers the radially outermost portion of the disk cooling member 12 between the ice removal blades 30 for preventing wobble of the cooling member. This permits the ice removal blades 30 to be mounted in close proximity to the cooling surfaces 24 of the cooling member 12. Additionally, the previously discussed flow passage 20 arrangement prevents the cooling member 12 from bending, flexing and/or warping permitting even closer placement of the ice removal blades 30 to the cooling member 12. Preferably, the gap between each ice removal blade 30 and the corresponding cooling surface 24 is no more than 0.007 inch. More preferably, the gap is set to a nominal clearance of 0.002 inch, with a maximum runnout of 0.005 inch, resulting in a maximum gap at any location on the disk of 0.007 inch.

Because of the close approach of the ice removal blades 30 to the cooling surfaces 24 of the cooling member 12, the flake ice machine 10 is suitable for use in freezing non-saline, fresh water. Flakes of fresh water ice are readily removed by the ice removal blades 30 because the ice removal blades 30 are located in close proximity to the shear joint between the ice and the cooling surfaces 24, and because the guide member 34 and flow passage 20 arrangements prevents the cooling member 12 from deflecting away from the ice removal blades 30.

By way of non-limiting example, a cooling member 12 having a nominal diameter of 15.25 inches (machined dimension) and a nominal thickness of 0.40 inch (formed from a disk plate 16 of 0.33 inch thickness with a passage 20 depth of 0.26 inch and a cover plate 17 thickness of 0.07 inch). A disk constructed in accordance with the present invention having these dimensions is capable of producing 2000 pounds (907 kilograms) of fresh water or saline (sea water) ice during 24 hours of operation. This rate applies when water to be frozen is supplied at a temperature of 60° F. (16° C.), evaporative refrigerant is supplied at a temperature of −10° F. evaporating temperature at 95° F. condensing temperature, and the ambient temperature is between 40° F. to 80° F. (5° C. to 26° C.). This capacity is provided by way of illustration only, and the nominal dimensions of the disk cooling member 12 and operation parameters can be varied to adjust the rate of ice production. Likewise, more than one cooling disk member 12 can be mounted in a larger flake ice machine 10 to increase capacity. The diameter of the cooling disk member 12 can also be adjusted to increase or decrease capacity.

In an alternate embodiment of the present invention, the cooling surfaces 24 of the cooling member 12 are treated after machining or casting, to enhance release of ice in large flakes. In the aforementioned embodiment, the cooling surfaces 24 are treated by shot peening to produce a textured surface which more readily releases ice. In a more preferred embodiment of the invention, the cooling surfaces 24 are coated with a low-wetting coating that further enhances removal of ice in large flakes. Thus, referring to FIGS. 1 and 2, the cooling surface 24 is completed by a coating 90 applied to the exterior surface 89 of the cooling disk 12. The coating 90 is a low-wetting and low-friction coating. Preferred coatings are fluoropolymers. The preferred fluoropolymer coating is a polytetrafluoroethylene (PTFE) coating. Suitable PTFE coatings commercially available from DuPont, under the trademarks TEFLON® and TEFLON-s®, and from Fabriform Plastics, Seattle, Wash., under the product identifier K-104. Other fluoropolymer coatings which are believed to be suitable include fluorinated ethylene propylene (FEP) copolymer, perfluoroalkoxy (PFA) resin, and ethylene-tetrafluoroethylene (ETFE) copolymer. These fluoropolymers typically have coefficients of friction of less than 0.4, exhibit high wear resistance when used as coatings on the present invention for in excess of 800 hours, and exhibit low wetting by water such that flakes of ice of at least a predetermined size may be removed from the disk. Fluoropolymers also exhibit good corrosion resistance and chemical resistance, and are USDA approved for use with food.

The coating is applied by first treating the exterior surface 89 of the cooling disk 12 (which may suitably be constructed from stainless steel) by glass bead blasting or grit blasting. The coating 90 is then sprayed on to a thickness of approximately 0.0005 to 0.0008 inches. Other application methods, such as powder coating, may also be suitably employed. This coating is then cured by application of heat, such as at a temperature of 350° to 650° F. depending on the exact fluoropolymer composition employed. The result is a coating 90 having an even thickness.

Use of the coating 90 permits the formation of ice that may be removed from the cooling disk surfaces 24 in large flakes. Particularly, when a fluoropolymer is used for the coating 90, large ice flakes of about 1 inch in diameter may be produced from fresh water, i.e., water to which salt has not been added. This flake size is typical of that conventionally obtained from saline water, but much greater than that conventionally obtained with a non-coated disk using fresh water. Thus, the desirable large flake size of saline water ice is produced from fresh water, while the off-taste, corrosion and maintenance associated with salt content are avoided.

Use of fluoropolymer coating 90 also presents a further advantage in that it permits the ice removal blades 30 to be positioned a greater distance away from the cooling surface 24 than would otherwise be permitted. Because the ice flakes are removed with less force and in larger pieces, the scraper edges of the ice removal blades 30 may be spaced greater than 0.010 inches, and preferably approximately 0.020 inches, away from the cooling surfaces 24, thus eliminating the possibility of wear of the blades due to contact with the disk surfaces.

An alternate coating that may be applied to the cooling surfaces 24 of the cooling disk 12 in accordance with the present invention is a nickel alloy plating that has been infused with polymers. One suitable coating is available under the trademark NEDOX®, by General Magnaplate Corp., Ventura, Calif. The coating is applied to a thickness of 0.002 to 0.003 inches and has a low coefficient of friction and a high degree of wear resistance. This coating enhances flake ice release relative to a non-coated disk. However, this material is not found to be as preferred as the fluoropolymer coatings.

While a preferred and alternate embodiments of a flake ice machine 10 constructed in accordance with the present invention has been described above, it should be readily apparent that those of ordinary skill in the art will be able to make various alterations and modifications to the design within the scope of the present invention. It is therefore intended that the scope of Letters Patent granted hereon be limited only by the definitions contained in the appended claims and equivalents thereto.

The embodiments of the invention in which an exclusive property or privilege is claimed are defined as follows:

1. A flake ice machine for producing flakes of a frozen material, comprising:

a rotatable cooling disk defining an external cooling surface and an internal refrigerant flow passage;

a refrigerant supply for supplying refrigerant to the internal refrigerant flow passage to cool the cooling disk;

a motor coupled to the cooling disk for driving rotation of the cooling disk;

a liquid material supply to introduce liquid material to be frozen to the external cooling surface of the disk;

an ice removal tool disposed adjacent to the external cooling surface of the disk member to remove flakes of frozen material, wherein the ice removal tool defines a scraper edge that is disposed greater than 0.010 inches from the external cooling surface; and a low-wetting coating applied to the external cooling surface of the cooling disk to enhance removal of large flakes of frozen material.

2. The flake ice machine of claim 1, wherein the low-wetting coating comprises a fluoropolymer.

3. The flake ice machine of claim 2, wherein the liquid material supply supplies fresh water to be frozen on the external cooling surface.

4. The flake ice machine of claim 2, wherein the fluoropolymer comprises polytetrafluoroethylene.

5. The flake ice machine of claim 1, wherein the liquid material supply supplies fresh water to be frozen on the external cooling surface.

6. The flake ice machine of claim 1, wherein the low-wetting coating comprises a polymer-infused nickel alloy coating.

7. A flake ice machine for producing flakes of a frozen material, comprising:

a rotatable cooling disk defining an external cooling surface and an internal refrigerant flow passage, wherein the external cooling surface has been texturized to enhance removal of large flakes of ice from the external cooling surface;

a refrigerant supply for supplying refrigerant to the internal refrigerant flow passage to cool the cooling disk;

a motor coupled to the cooling disk for driving rotation of the cooling disk;

a liquid material supply to introduce liquid material to be frozen to the external cooling surface of the disk; and an ice removal tool disposed adjacent to the external cooling surface of the disk member to remove flakes of frozen material.

8. The flake ice machine of claim 7, wherein the external cooling surface has been treated by shot peening.

9. The flake ice machine of claim 8, wherein the ice removal tool defines a scraper edge that is disposed greater than 0.010 inches from the external cooling surface.

10. A flake ice machine for producing flakes of a frozen material, comprising:

a cooling member defining a cooling surface;

means for cooling the cooling member;

means for applying liquid material to be frozen to the cooling surface of the cooling member;

an ice removal tool disposed adjacent to the cooling member, wherein the cooling member is movable relative to the ice removal tool to remove flakes of frozen material; and wherein the external cooling surface of the cooling member has been texturized to enhance removal of large flakes of frozen material.

11. The flake ice machine of claim 10, wherein the liquid material supply supplies fresh water to be frozen on the external cooling surface.

12. The flake ice machine of claim 10, wherein the ice removal blade defines a scraper edge that is disposed greater than 0.010 inches from the external cooling surface.

* * * * *